US006828722B2

(12) United States Patent
Ueda et al.

(10) Patent No.: US 6,828,722 B2
(45) Date of Patent: Dec. 7, 2004

(54) ELECTRON BEAM APPARATUS AND IMAGE DISPLAY APPARATUS USING THE ELECTRON BEAM APPARATUS

(75) Inventors: Kazuyuki Ueda, Tokyo (JP); Kenji Niibori, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/655,013

(22) Filed: Sep. 5, 2003

(65) Prior Publication Data

US 2004/0051443 A1 Mar. 18, 2004

(30) Foreign Application Priority Data

Sep. 17, 2002 (JP) ..... 2002-270132

(51) Int. Cl.[7] ..... H01J 1/62

(52) U.S. Cl. ..... 313/495; 313/306; 313/336

(58) Field of Search ..... 313/495, 497, 313/336, 306

(56) References Cited

U.S. PATENT DOCUMENTS

| | | | | |
|---|---|---|---|---|
| 4,904,895 | A | 2/1990 | Tsukamoto et al. | 313/336 |
| 5,066,883 | A | 11/1991 | Yoshioka et al. | 313/309 |
| 6,254,449 | B1 | 7/2001 | Nakanishi et al. | 445/25 |
| 6,506,089 | B2 | 1/2003 | Nakanishi et al. | 445/25 |
| 6,541,905 | B1 * | 4/2003 | Fushimi et al. | 313/495 |
| 6,566,794 | B1 * | 5/2003 | Miyazaki | 313/292 |

FOREIGN PATENT DOCUMENTS

| | | |
|---|---|---|
| JP | 63-274047 | 11/1988 |
| JP | 2-257551 | 10/1990 |

OTHER PUBLICATIONS

M. Hartwell et al., *Strong Electron Emission from Patterened Tin–Indium Oxide Thin Films*, IEEE Trans. ED Conf. 519 (1975).

H. Araki et al., *Electroforming and Electron Emission of Carbon Thin Films*, vol. 26., No. 1, 22 (1983).

R. Meyer et al., *Recent Development on "Microtips" Display at Leti*, Technical Digest of IVMC 91, Nagahama, 1991, pp. 6–9.

G. Dittmer, *Electrical Conduction and Electron Emission of Discontinuous Thin Films*, Thin Solid Films, 9 (1972) pp. 317–328.

M.I. Elinson, et al., *The Emission of Hot Electrons and the Field Emission of Electrons form Tix Oxide*, Radio Eng. Electron Phys., 1965, pp. 1290–1296.

* cited by examiner

*Primary Examiner*—David Vu
(74) *Attorney, Agent, or Firm*—Fitzpatrick, Cella, Harper & Scinto

(57) ABSTRACT

Distances between spacers and electron passing apertures in potential regulation plate are regulated. An electron beam apparatus includes a first substrate having a region from which electrons are emitted, a second substrate having a region which is irradiated by the emitted electrons, spacers located between the first substrate and the second substrate for forming an atmospheric pressure resistant structure, and at least one potential regulation plate having aperture portions, through which electrons emitted from the first substrate pass, between the first substrate and the second substrate, wherein the potential regulation plate has recessed portions, to which the spacers fitted on, on one principal surface of the potential regulation plate, and a part of the other principal surface of the potential regulation plate abuts on the first substrate and/or the second substrate in the state in which the spacers are fitted to the recessed portions.

18 Claims, 7 Drawing Sheets

ELECTRON BEAM APPARATUS AND IMAGE DISPLAY APPARATUS USING THE ELECTRON BEAM APPARATUS

BACKGROUND OF THE INVENTION

1. Field of the Invention

The present invention relates to an electron beam apparatus including a first substrate having an region from which electrons are emitted, a second substrate having an region which is irradiated by the emitted electrons, and a spacer arranged between the first and the second substrates for forming an atmospheric pressure resistant structure, and to an image display apparatus using the electron beam apparatus.

2. Related Background Art

Two kinds of electron-emitting devices which are a hot-cathode device and a cold-cathode device are conventionally known. As the cold-cathode device, for example, a surface conduction type electron-emitting device, a field emission type (FE type) electron-emitting device, a metal/insulating layer/metal type (MIM type) electron-emitting device and the like are known.

The surface conduction type electron-emitting device utilizes the phenomenon in which electrons are emitted by the current flowing parallel to the surface of the thin film which is formed on the substrate and has a small area. As the surface conduction type electron-emitting device, for example, the following devices are known: the device using a $SnO_2$ thin film which is disclosed in M. I. Elinson, "Radio Eng. Electron Phys", 10, 1290, (1965), the device using an Au thin film which is disclosed in G. Dittmer, "Thin Solid Films", 9, 317 (1972), the device using $In_2O_3/SnO_2$ thin film which is disclosed in M. Hartwell and C. G. Fonstad, "IEEE Trans. ED Conf.", 519 (1975), the device using a carbon thin film which is disclosed in H. Araki, "Vacuum", vol. 26, No. 1, 22 (1983), and the like.

Because especially the surface conduction type electron-emitting device has a simple structure and is easily produced among the cold-cathode type electron-emitting devices, the surface conduction type electron-emitting device has an advantage that many devices can be formed over a large area. Moreover, as the application of the surface conduction type electron-emitting device, for example, the application to an image display apparatus, an image formation apparatus such as an image recording apparatus and the like, a charged beam source, and the like has been researched. In particular, as the application to the image display apparatus, for example, the present applicant proposed an image display apparatus using surface conduction type electron-emitting devices in combination with phosphors which emitted light by being irradiated by electron beams as it was disclosed in U.S. Patent No. 5,066,883. The image display apparatus using the surface conduction type electron-emitting devices in combination with the phosphors is expected to have superior characteristics in comparison with other conventional type image display apparatus. For example, even if the image display apparatus is compared with a liquid crystal display apparatus which has come into wide use recently, the image display apparatus has advantage in that the image display apparatus does not need any backlight because the apparatus is self light emission type, and in that the image display apparatus has a wide view angle.

On the other hand, a method for driving many arranged FE type electron-emitting device is disclosed in U.S. Pat. No. 4,904,895 by the present applicant. Moreover, as an example of the application of the FE type electron-emitting device to an image display apparatus, for example, a flat-panel type display apparatus reported by R. Meyer (R. Meyer "Recent Development Micro-tips Display at LETI", Tech. Digest of $4^{th}$ Int. Vacuum Micro Electronics Conf. Nagahama, pp. 6–9 (1991)) is known.

Moreover, in recent years, it has been examined to use a carbon nanotube as an electron-emitting device.

Among the image formation apparatus using the electron-emitting devices as described above, because the flat panel type display apparatus having a thin depth can save a space and is light in weight, the flat panel type display is attracting public attention as one to replace a cathode-ray tube type display apparatus.

FIG. 11 is a perspective view showing an example of the flat panel type image display apparatus. The panel of the display apparatus is shown in a partially cutaway state for showing the internal structure of the apparatus. As shown in FIG. 11, a plurality of cold-cathode devices (hereupon, surface conduction type electron-emitting devices are shown as an example) 3112, which are electron sources, is formed in a matrix on a substrate 3111. The substrate 3111 is piled on a rear plate 3115. The rear plate 3115, a side wall 3116 forming a frame, and a face plate 3117, on which a fluorescent film 3118 and an anode electrode (a metal back) 3119 are formed, constitute an envelope (a hermetic container) for keeping the inside of the display panel vacuum. Incidentally, the cold-cathode devices 3112 are connected to wiring 3113 and 3114 arranged in a matrix.

The inside of the hermetic container is kept to be vacuum at about $1.33\times10^{-4}$ Pa ($10^{-6}$ Torr). The larger the display area of the image display apparatus becomes, the more the means for preventing the deformation or the destruction of the rear plate 3115 and the faceplate 3117 caused by atmospheric pressure difference between the inside of the hermetic container and the outside thereof becomes necessary. The method for preventing the deformation or the destruction by thickening the rear plate 3115 and the face plate 3117 causes the distortion of images and parallax when the image display apparatus is looked at obliquely in addition to the increase of the weight of the image display apparatus. Accordingly, as shown in FIG. 11, spacers (called as ribs in some cases) 312, which are made of relatively thin glass plates and are structural supporting members for withstanding the atmospheric pressure, are provided. By the spacers 3120, the interval between the rear plate 3115 and the face pate 3117, more correctly the interval between the substrate 3111, on which a multi-beam electron source is formed, and the metal back 3119, is normally kept to be several millimeters or less, and the inside of the hermetic container is kept to be highly vacuum, as described above.

The necessary number of the spacers 3120 judged from the structural viewpoint is effectively arranged. When the spacers 3120 are formed to have a length shorter than the image display region (the region in which the metal back 3119 is formed and the orthogonal projection region of the metal back 3119 to the rear plate 3115), the number of the spacers 3120 and the setting man-hour of the spacers 3120 are obliged to increase. Accordingly, it is preferable to provide the spacers 3120 having a length equal to the image display region or longer.

The image display apparatus described above has the following problems.

Electron beams emitted from the electron-emitting devices of the substrate 3111 on the rear plate 3115 to the face plate 3117 impinge on the face plate 3117. After the impingement, a part of the electrons are reflected as secondary electrons, and are emitted to the substrate 3111 and the spacers 3120. When the substrate 3111 is charged excessively owing to the secondary electrons which impinged on the substrate 3111, the substrate 3111 generate discharges, which give bad influence to images. Moreover, when the spacers 3120 is charged excessively owing to the secondary electrons which impinge on spacers 3120, the charging gives influence to the orbits of the electron beams near to the spacers 3120 to change the irradiation positions on the face plate 3117. Consequently, the uniformity of the images near to the spacers 3120 decreases to give bad influence to the image qualities.

It is known that the location of a potential regulation plate made of metal between the rear plate 3115 and the face plate 3117 in the state of being parallel to both the plates (the substrate) is effective. The potential regulation plate has thorough holes at the positions where electron beams pass through and at the positions where the spacers 3120 are arranged. However, it is very difficult to locate the potential regulation plate to keep the even intervals between the rear plate 3115 and the face plate 3117 all over the surfaces, and the spaces 3120 and the potential regulation plate are required to be fixed at accurate positions. Consequently, the cost was high.

SUMMARY OF THE INVENTION

In view of the problems as mentioned above, it is one objective of the present invention to provide an electron beam apparatus capable of locating an potential regulation plate and spacers simply and inexpensively between a rear plate being a first plate and a face plate being a second plate, and capable of decreasing the quantity of the charging of the electrons reflected by the second substrate on the first substrate and the spacers to make it possible to keep stable images. Another object of the present invention is provide an image display apparatus using the electron beam apparatus and a manufacturing method of the electron beam apparatus.

To achieve the objectives as mentioned above, the present invention provides an electron beam apparatus including a first substrate having a region from which electrons are emitted, a second substrate having a region which is irradiated with the emitted electrons, and at least one spacer located between the first substrate and the second substrate for forming an atmospheric pressure resistant structure. And, this apparatus is particularly unique in having at least one potential regulation plate including an aperture portion, through which electrons emitted from the first substrate pass, between the first substrate and the second substrate, wherein the potential regulation plate includes a recessed portion, to which the spacer fitted, on one principal surface of the potential regulation plate, and a part of the other principal surface of the potential regulation plate abuts on the first substrate or the second substrate in a state in which the spacer is fitted to the recessed portion.

Moreover, an image display apparatus of the present invention is an image display apparatus, comprising an electron beam apparatus of the present invention, wherein an image formation member forming an image by impingement of electrons is provided in the region of the electron beam apparatus, the region irradiated by emitted electrons.

According to the present invention, when the potential regulation plate is located between the first substrate and the second substrate and the fist substrate and the second substrate is joined to each other with a spacer interposed between them, the spacer is inserted in the recessed portion (a groove in the shape of a letter U, a letter U with a flat bottom, a letter V, or the like) formed on one principal surface of the potential regulation plate to arrange the spacer on the potential regulation plate. Because the intervals between the spacers are determined to be the intervals of the recessed portions of the potential regulation plate uniquely, the arrangement of the electron beam passing through apertures (aperture portions) and the spacers are accurate, and there in no need for using any expensive location apparatus.

As a result, the potential regulation plate and the spacers can be arranged between the first substrate and the second substrate simply and inexpensively. The quantity of electrons which have been reflected by the second substrate and are charged on the first substrate and the spacers can be decreased. Consequently, an electron beam apparatus which can keep stable images and an image display apparatus using the electron beam apparatus can be provided.

Moreover, a projected portion is formed on a portion of the other principal surface of the potential regulation plate, at which portion the potential regulation plate abuts on the first substrate or the second substrate. Thereby, the portion of the potential regulation plate where the through hole formed for making electron beams pass through the through hole is regulated by the height of the projected portion of the potential regulation plate. Consequently, the interval between the potential regulation plate and the first substrate or the second substrate can be kept to be uniquely constant all over the surface of the potential regulation plate.

DETAILED DESCRIPTION OF THE PREFERRED EMBODIMENTS

Hereinafter, the preferred embodiments of the present invention will be described.

(First Embodiment)

Figure 1:
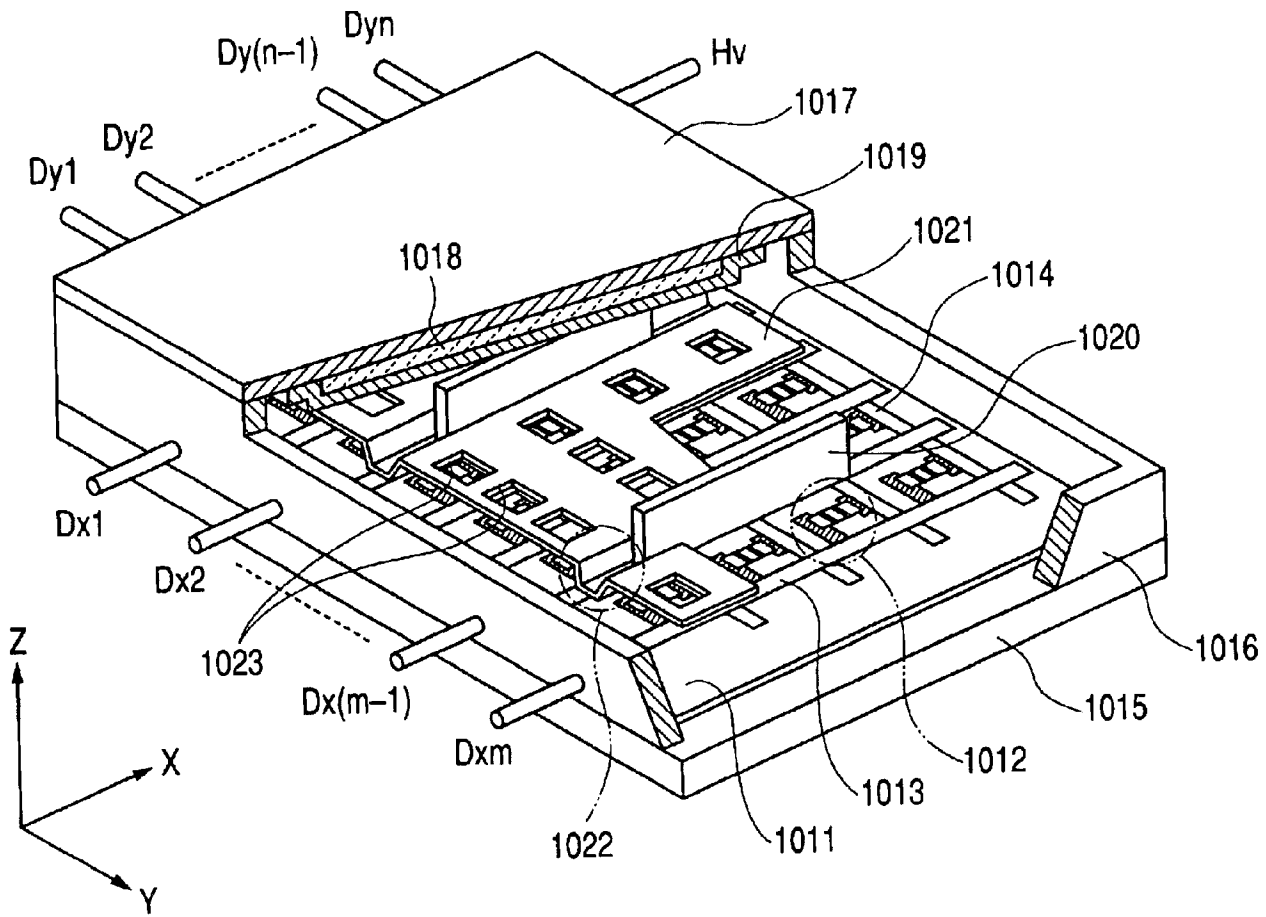
FIG. 1 is a perspective view of a partially cutaway display panel according to an image display apparatus of the present invention.

FIG. 1 is a perspective view of an embodiment of an image display apparatus of the present invention. The panel of the image display apparatus is partially cut away for showing the internal structure thereof. In the figure, a reference numeral 1015 designates a rear plate as a first substrate. A reference numeral 1016 designates a side wall as a frame. A reference numeral 1017 designates a face plate as a second substrate. The rear plate 1015, the side wall 1016 and the face plate 1017 constitute a hermetic container (an envelope) for keeping the inside of the display panel vacuum.

Moreover, because the inside of the hermetic container is kept to be vacuum at about $1.33\times10^{-4}$ Pa ($10^{-6}$ Torr), spacers 1020 as atmospheric pressure withstanding structures are provided with the object of the prevention of the destruction of the hermetic container caused by the atmospheric pressure or an sudden impact.

A substrate 1011 is fixed on the rear plate 1015. On the substrate 1011, N×M of cold-cathode devices (hereupon, surface conduction type electron-emitting devices are shown as an example) 1012 are formed. Incidentally, the letters N and M designate positive integers equal to two or more, and are appropriately set according to the aimed number of display pixels. The cold-cathode devices 1012 are wired to be a simple matrix with row direction wiring 1013 and column direction wiring 1014.

A fluorescent film 1018 is formed on the under surface of the face plate 1017. The phosphor of each color is separately coated, for example, in a stripe. Black conductive materials (not shown) are provided between the phosphors in the stripe.

A metal back 1019, which is publicly known in the field of a cathode ray tube (CRT), is provided on the surface of the fluorescent film 1018 on the side of the rear plate 1015.

The spacers 1020 are severally made of an insulating member in a thin plate state having a high resistance film formed on the surface of the insulating member, and electrodes (not shown) formed on the abutting surfaces of the spacer 1020 which are severally opposed to the inside of the face plate 1017 and the surface (the row direction wiring 1013) of the substrate 1011.

A grid 1021 being a potential regulation plate is interposed between the substrate 1011 or the face plate 1017 and the spacers 1020.

Figure 9A:
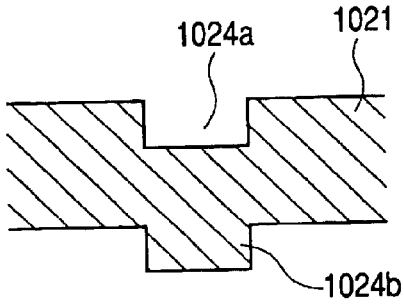
FIGS. 9A and 9B are sectional views of a groove portion of a spacer.
Figure 9B:
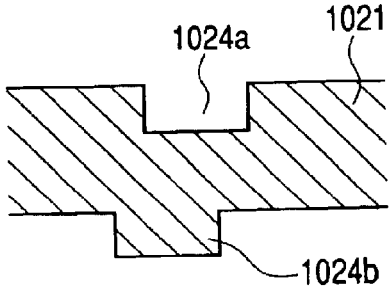
Figure 10:
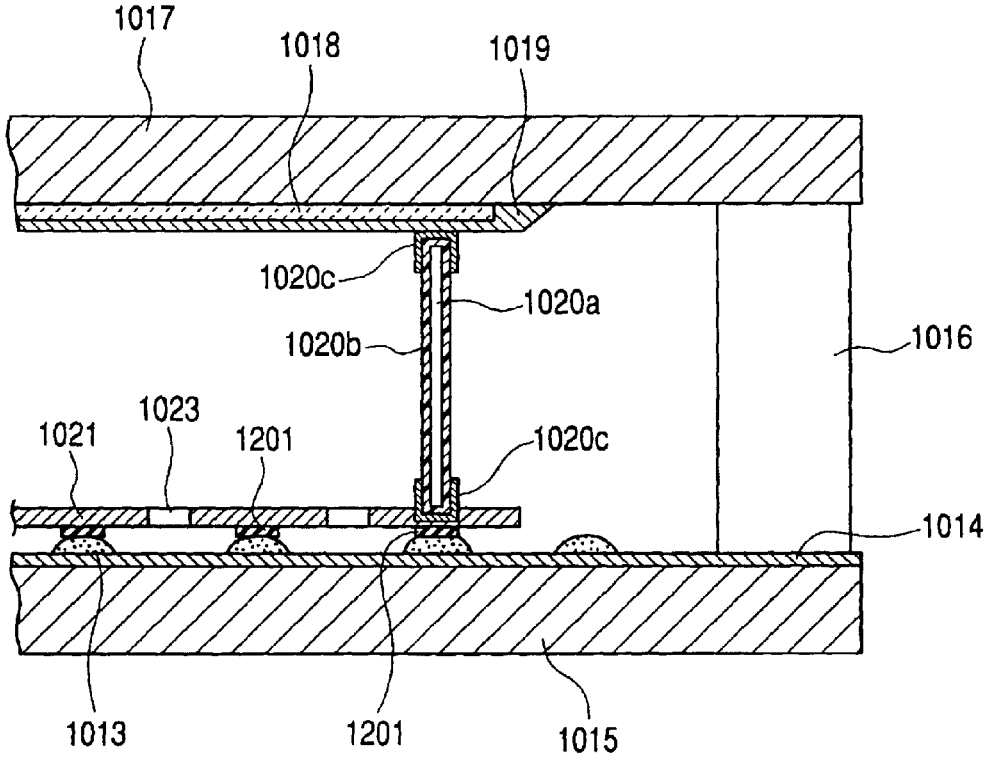
FIG. 10 is a sectional view of a display panel according to an image display apparatus of a fourth embodiment of the present invention.
Figure 11:
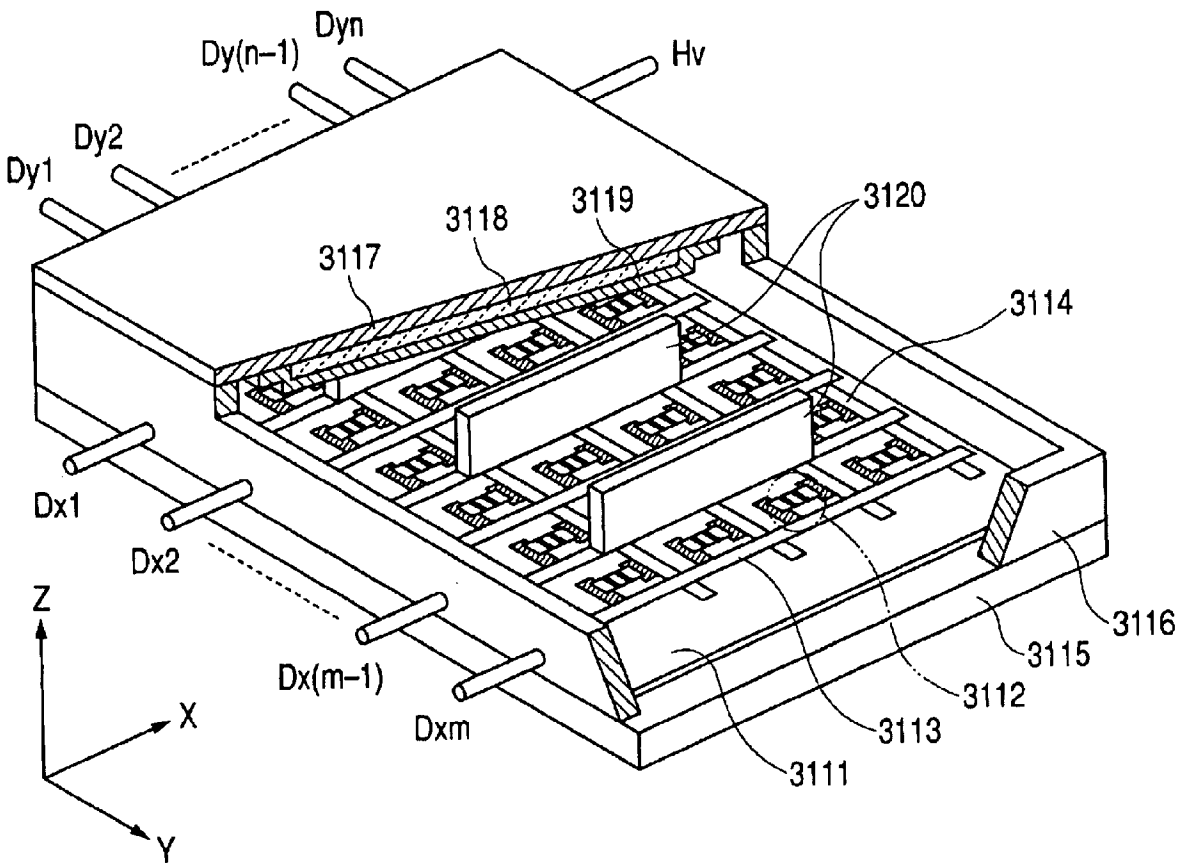
FIG. 11 is a perspective view of a partially cutaway display panel according to a conventional image display apparatus.

The grid 1021 is a thin metal plate. Grid groove portions 1022 having widths, which are substantially the same as the widths of the spacers 1020, are arranged at the portions at which the grid 1021 abuts with the spacers 1021. The grid groove portions 1022 has severally a cross section shaped in a letter U substantially. The groove portions 1022 form recessed portions on one principal surface of the grid 1021 and projected portions on the other principal surface thereof. Incidentally, the projected portions may be unformed as shown in FIG. 10, which will be described later. The shapes of the grid groove portions 1021 are not specially limited. The shapes may be ones capable of being fitted to the spacers 1020. For example, the shapes may be a letter U having a flat bottom, a letter V (in this case, it is preferable to form the ends of the spacers 1020 to be trapezoids or shapes sharp at the points), or the like. Moreover, as shown in FIG. 9A, the projected portions 1024*b* of the grid 1021 are preferably formed directly (right) under the recessed portions 1024*a* in consideration of the strength of the grid 1021 because the projected portions 1024*b* are arranged directly under the spacers 1020 to abut with the substrate 1011. However, as shown in FIG. 9B, the positions of the projected portions 1024*b* may be shifted from the positions of the recessed portions 1024*a*. The projected portions 1024*b* and the recessed portions 1024*a* of the grid 1021 can be formed integrally by means of press working or the like. Moreover, holes may be formed at the tips of the recessed portions (portions to touch the row direction wiring 1013) of the projected portions 1024*b* of the grid groove portions 1022.

The grid 1021 is fixed to the substrate 1011 or the face plate 1017. The projected portions 1024*b* of the grid groove portions 1022 are arranged at the portions abutting on the row direction wiring 1013 of the substrate 1011 or the portions abutting on the face plate 1017. In the case where the projected portions 1024*b* abuts on the row direction wiring 1013 of the substrate 1011, the widths of the grid groove portions 1022 are set to be equal to the widths of the row direction wiring 1013.

The spacers 1020 are fitted to the grid groove portions 1022. The spacers 1020 are glued to the grid groove portions 1022 to be fixed thereto with a conductive adhesive. Moreover, grid aperture portions 1023 are arranged at the portions of the grid 1021 corresponding to the positions of the cold-cathode devices 1012.

The grid aperture portions 1023 are located at the positions where the grid 1021 does not block out the electron beams emitted from the cold-cathode devices 1012.

Figure 2:
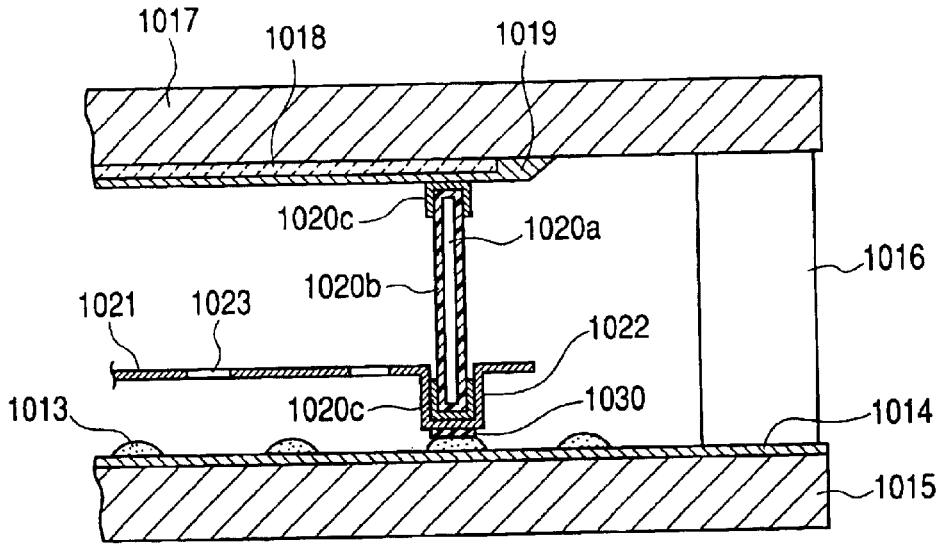
FIG. 2 is a schematic sectional view along a Y-Z plane in FIG. 1.

FIG. 2 shows a Y–Z sectional view of FIG. 1. Incidentally, the substrate 1011 is omitted to be shown in FIG. 2. As shown in FIG. 2, the spacers 1020 are severally made of an insulating member (a matrix) 1020*a* in a thin plate state having a high resistance film 1020*b* formed on the surface of the insulating member, and conductive films (low resistance films) 1020*c* formed on the abutting surfaces on the inside of the face plate 1017 and the grid 1021.

The spacers 1020 in the state of thin plates are arranged along the row directions (X-directions), and are fixed to the rear plate 1015 with the grid 1021 put between the spaces 1020 and the rear plate 1015. Incidentally, it is possible to adopt the spacers longer than the image formation region (the region where the phosphors and metal back 1019 are formed) as the spacers 1020.

The grid 1021 fits to the conductive films (lot resistance films) 1020*c* at the grid groove portions 1022, and is put between the conductive films 1020*c* and row direction wiring insulating layers (not shown) formed on the row direction (X-direction) wiring 1013.

The grid groove portions 1022 are grooves having the widths almost the same as the widths of the spacers 1020. The grid groove portions 1022 are fitted with the spacers 1020, and are fixed to the spacers 1020 with a conductive adhesive (not shown) to be integrated with the spacers 1020. Consequently, the spacer conductive films (low resistance films) 1020*c* fitted to the grid 1021 has the same electric potential as that of the grid 1021.

The grid 1021, which is located on the substrate 1011 with the grid groove portions 1022 fixed on the row direction wiring insulating layer (not shown) with adhesives 1030, is worked so that the grid aperture portions 1023 of the grid 1021 is located right above the cold-cathode devices 1012.

Moreover, the shapes of the grid aperture portions 1023 are formed to have aperture areas which are sufficient not for preventing the electron beams emitted from the cold-cathode devices 1012 to the fluorescent film 1018.

Figure 3:
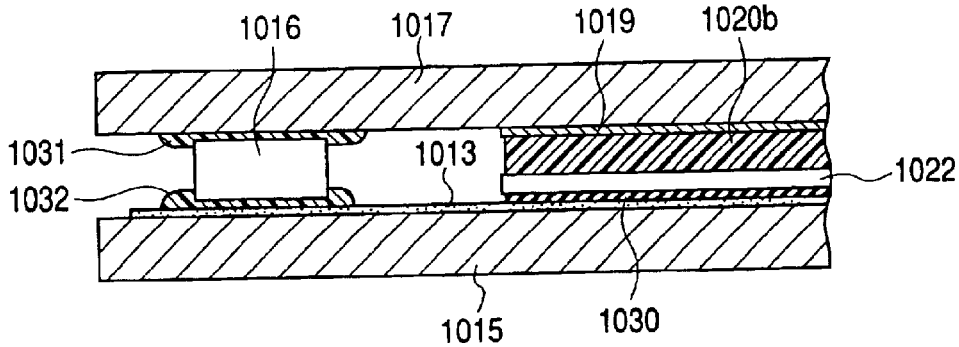
FIG. 3 is a schematic sectional view along an X-Z plane in FIG. 1.

FIG. 3 shows an X–Z sectional view of FIG. 1. As shown in FIG. 3, the face plate 1017 is joined to the side wall 1016 with an adhesive 1031. The rear plate 1015 mounting the substrate 1011 thereon is joined to the side wall 1016 with an adhesive 1032. Thereby, the hermetic container is constituted.

The spacers 1020 and the grid 1021 are put between the face plate 1017 and the rear plate 1015. One end surface of each of the spacers 1020 is touched to the metal back 1019 formed on the inner surface of the face plate 1017.

The other end surface of each of the spaces 1020 is fitted to each of the grid groove portions 1022 of the grid 1021. The grid groove portions 1022 are touched to the row direction insulating layer (not shown) on the row direction wiring 1013 formed on the inner surface of the rear plate 1015. The grid groove portions 1022 are fixed to the row direction insulating layer with the adhesives 1030.

(Assembly of Hermetic Container)

Figure 4:
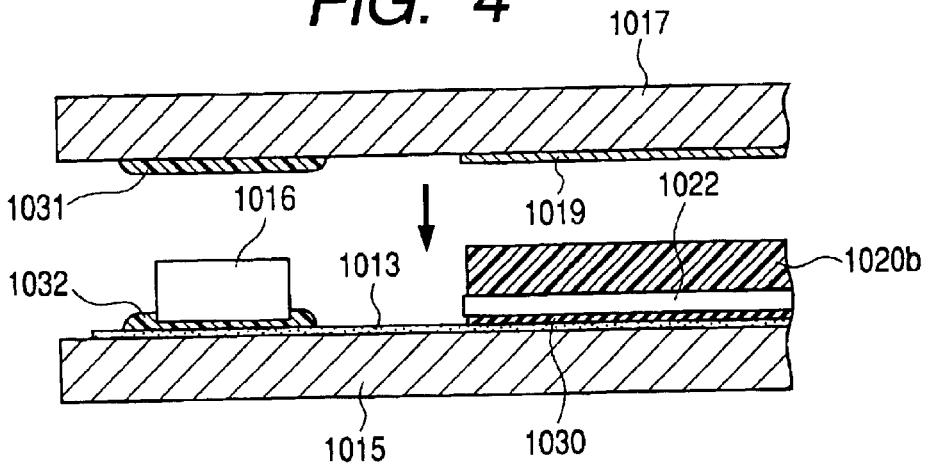
FIG. 4 is an explanatory view of an assembly process of the display panel show in FIG. 1.

Next, FIG. 4, which is an explanatory view for illustrating assembly at the same cross section as that of FIG. 3, is referred to while an assembly procedure of the hermetic container is described.

First, the column direction wiring 1014 (see FIG. 1), the row direction wiring 1013 and the like are formed on the substrate 1011. The row direction wiring insulating layers (not shown) are formed on the row direction wiring 1013. The substrate 1011 is fixed to the rear plate 1015 with an adhesive (not shown). Next, the side wall 1016 is joined to the inner surface of the rear plate 1015 with the adhesive 1032.

After that, the spaces 1020 having almost the same heights as that of the side wall 1016 are fitted to the grid groove portions 1022, and joined to the grid groove portions 1022 with conductive adhesives (not shown). The grid groove portions 1022 are formed at the same pitches as the intervals of the spacers 1020.

Moreover, the intervals of the spacers 1020 are a multiple of the pitches of the row direction wiring 1013.

Furthermore, the grid 1021 is joined to the substrate 1011. At this time, the grid groove portions 1022 of the grid 1021 and the row direction wiring 1013 are made to coincide with each other. Then, the grid groove portions 1022 are fixed on the row direction wiring 1013 with the adhesive 1030.

Next, the adhesive 1031 is coated on the inner surface of he face plate 1017, on which the fluorescent film 1018 (see FIG. 1) and the metal back 1019 are formed. As show in FIG. 1, the adhesive 1031 is coated at the portions of the face plate 1017 abutting on the side wall 1016 fixed to the rear plate 1015.

Next, the face plate 1017, on which the adhesive 1031 has been coated, is aligned with the rear plate 1015, on which the side wall 1016, the spacers 1020 and the grid 1021 have been fixed. After the adhesive 1031 is softened, the rear plate 1015 and the face plate 1017 are joined to each other to form the envelope.

At this time, the end faces of the spacers 1020 opposed to the face plates 1017 are touched to the metal back 1019 to have an atmospheric pressure resistant supporting function between the face plate 1017 and the rear plate 1015.

Moreover, the grid 1021 is located at an intermediate position between the face plate 1017 and the rear plate 1015. The electric potential of the grid 1021 can be regulated by supplying an arbitrary potential value of the potential values of the face plate 1017 and the rear plate 1015.

Incidentally, it can be implemented by connecting the grid 1021 to the row direction wiring 1013 (without interposing the row direction wiring insulating layer between them) electrically with a conductive adhesive or the like to form the grid 1021 on the side of the rear plate 1015 and to supply the same electric potential to the grid 1021 as the electric potential of the row direction wiring 1013. Moreover, it can be implemented by connecting the grid 1021 to the metal back 1019 electrically to form the grid 1021 on the side of the face plate 1017 and to supply the same electric potential to the grid 1021 as the electric potential of the metal back 1019. It can be also implemented to give the grid 1021 arbitrary electric potential by providing power supply wiring on the side of the rear plate 1015 and/or the side of the face plate 1017 to connect the provided power supply wiring to the grid 1021, and by providing an electrical connection terminal connected to the power supply wiring to supply a predetermined voltage to the electrical connection terminal from the outside.

As described above, the spacers 1020 are glued to the grid groove portions 1022 of the grid 1021, and then the spacers 1020 are interposed between the face plate 1017 and the rear plate 1015. Thereby, the atmospheric pressure resistant supporting structure of the envelope is formed. Consequently, the aligning process of the spacers 1020 and the grid 1021 can be simplified. Moreover, because the spacers 1020 and the grid 1021 are joined to each other, the aligning process of the face plate 1017 and the rear plate 1015 can be performed simultaneously.

Moreover, the distance of the grid aperture portions 1023 from the face plate 1017 or the rear plate 1015 can be regulated at the same time.

Moreover, when electron beams are radiated from the rear plate 1015 to the face plate 1017 to make the fluorescent film 1018 emit light, a part of the electrons in the electron beams is reflected by the metal back 1019 to be charged on the surface of the rear plate 1015 as secondary electrons. There is the case where the charged electrons are suddenly discharged to destroy the cold-cathode devices 1012. Because almost all of the secondary electrons are absorbed by the grid 1021, the sudden discharge can be suppressed remarkably.

In the present embodiment, the grid 1021 is joined to the side of the rear plate 1015, and the spacers 1020 are joined to the side of the face plate 1017. However, the reverse configuration such that the grid 1021 is joined to the side of the face plate 1017, and the spacers 1020 are joined to the side of the rear plate 1015 can bring about the similar effects.

Moreover, it is possible to join the grid 1021 to both of the ends of the spacers 1020 on the side of the face plate 1017 and the ends of the spacers 1020 on the side of the rear plate 1015. In this case, the suppressing effect of the sudden discharges becomes larger.

It is desirable that the material of the grid 1021 is one having the same coefficient of linear expansion as that of the glass members of the face plate 1017 and the rear plate 1015 such as a 426-alloy (42 weight percent of Ni, 6 weight percent of Co and the residual weight percent of Fe), a 48-alloy (48 weight percent of Ni and the residual weight percent of Fe) or the like. Moreover, the material made by performing the conductive surface processing to the ceramic, the glass or the like having the coefficients of linear expansion near to those of the face plate 1017 and the rear plate 1015 may be adopted.

(Image Display Apparatus)

The image display apparatus (the display panel) described above will be further described concretely.

In the display panel shown in FIG. 1, n×m cold-cathode devices 1012 are formed on the substrate 1011. The letters n and m indicate positive integers which are two or more. The n and m are suitably set according to aimed display pixels. For example, in the display apparatus aiming display in a high quality television, it is desirable to set the n to 3000 or more and m to 100 or more. The n×m cold-cathode devices are wired in a simple matrix state by means of m pieces of the row direction wiring 1013 and n pieces of the column direction wiring 1014. The substrate 1011, the cold-cathode devices 1012, the row direction wiring 1013 and the column direction wiring 1014 constitute the so-called multi electron beam source.

The multi electron beam source used in the image display apparatus of the present invention has no limitations of the materials, the shapes and the manufacturing methods of the cold-cathode devices 1012 as long as the electron source in which the cold-cathode devices 1012 are wired in the simple matrix state. Consequently, the cold-cathode devices 1012 such as surface conduction type electron-emitting devices, FE type electron-emitting devices, MIM type electron-emitting devices, electron-emitting devices using carbon nanotubes, or the like can be used. Hereupon, the structure of a multi electron beam source using the surface conduction type electron-emitting devices arranged on a substrate to be wired in the simple matrix state as the cold-cathode devices 1012 will be described.

Figure 5:
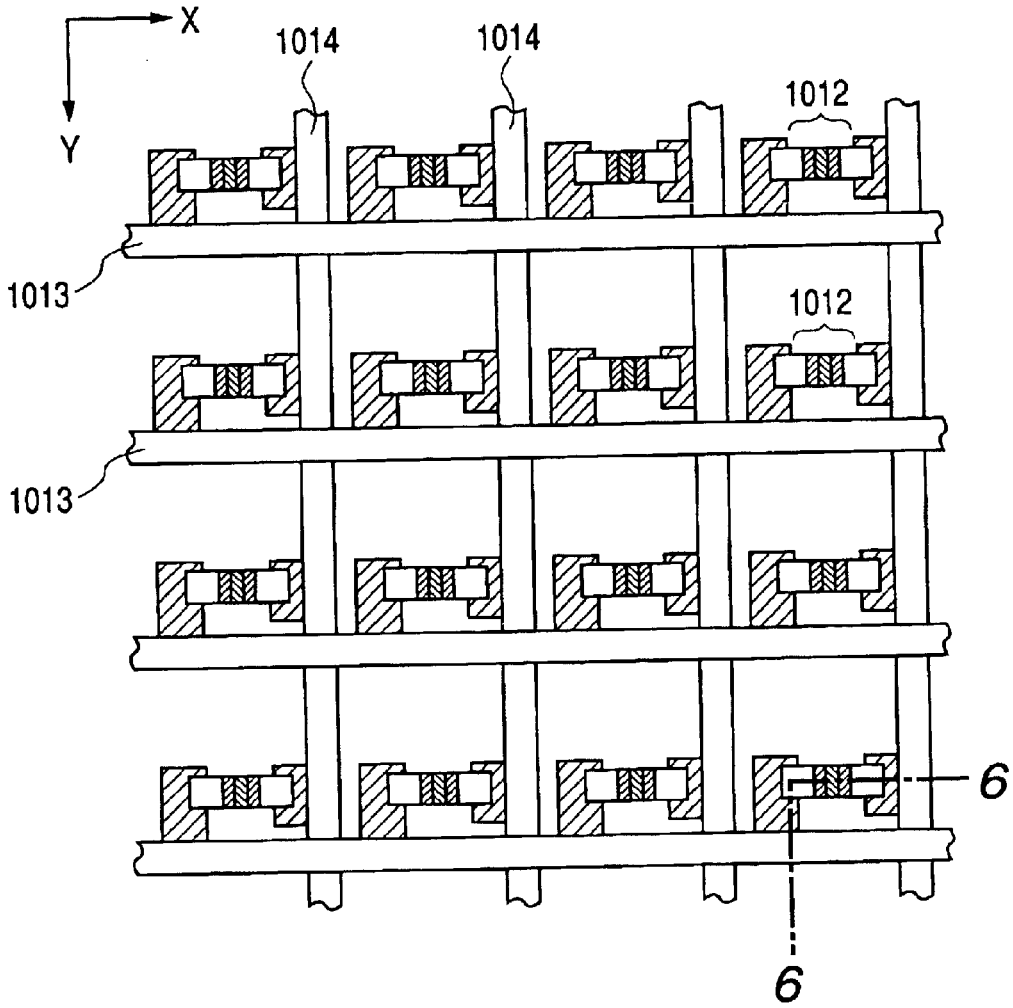
FIG. 5 is a plan view of a substrate of a multi-beam electron source of the display panel shown in FIG. 1.
Figure 6:
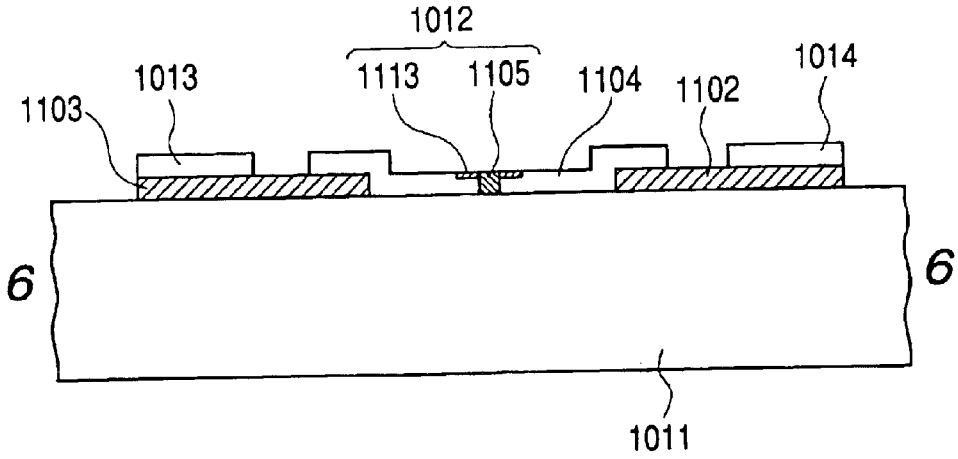
FIG. 6 is a sectional view along the 6—6 line in FIG. 5.

FIG. 5 is a plan view of the multi electron beam source adopted in the display panel shown in FIG. 1. FIG. 6 is a sectional view along the 6—6 line in FIG. 5. As shown in FIG. 5, the surface conduction type electron-emitting devices 1012 are arranged on the substrate 1011. The surface conduction type electron-emitting devices 1012 are wired in the simple matrix state by means of the row direction wiring 1013 and the column direction wiring 1014. Insulating layers (not shown) are formed between the electrodes of the row direction wiring 1013 and the column direction wiring 1014 at the positions where the row direction wiring 1013 and the column direction wiring 1014 crosses with each other, and thereby the electric insulation between the electrodes can be kept.

Incidentally, the multi electron beam source in such a structure is manufactured as follows. The row direction wiring 1013, the column direction wiring 1014, the inter-electrode insulating layer (not shown), device electrodes 1102 and 1103 and conductive thin films of the surface conduction type electron-emitting devices 1012 are previously formed on the substrate 1011. Then, thin films 1113 are formed in gap portions of the conductive thin films 1104 to form the gap portions to be electron-emitting portions 1105. After that, electric conduction forming processing and electric conduction activation processing by feeding each of the surface conduction type electron-emitting devices 1012 through the row direction wiring 1013 and the column direction wiring 1014 to manufacture the multi electron beam source.

The fluorescent film 1018 is formed on the under surface of the face plate 1017. The metal back 1019 is provided on the surface of the fluorescent film 1018 on the side of the rear plate 1017. To put it concretely, after the fluorescent film 1018 has been formed on the substrate of the face plate 1017, the surface of the fluorescent film 1018 is processed to be smooth. Then, the metal back 1019 is formed on the smoothed surface of the fluorescent film 1018 by the vacuum evaporation of Al. Because the present embodiment is a color display apparatus, the phosphors of three original colors of red, green and blue, which are used for a CRT, are separately coated as the fluorescent film 1018. By the metal back 1019, the mirror reflection of a part of the light emitted by the fluorescent film 1018 is performed to improve the light utilization factor of the display apparatus. Moreover, the metal back 1019 also protects the fluorescent film 1018 from the collision of negative ions. The metal back 1019 further acts as an electrode for applying an electron beam acceleration voltage. The metal back 1019 further performs the role of acting as the conducting path of the electrons which excited the fluorescent film 1018.

Incidentally, in the case where a phosphor material for low voltage use is used as the fluorescent film 1018, the metal back 1019 may not be used.

The present embodiment is configured to fix the substrate 1011 of the multi electron beam source to the rear plate 1015. But, in the case where the substrate 1011 of the multi electron beam source has sufficient strength, the substrate 1011 of the multi electron beam source itself may be used as the rear plate of the hermetic container.

Moreover, although the present embodiment does not use any transparent substrates, for example, a transparent substrate made of indium tin oxide (ITO) may be provided between the substrate of the face plate 1017 and the fluorescent film 1018 for with the object of the application of an acceleration voltage or the improvement of the conductivity of the fluorescent film 1018.

It is preferable that the spacers 1020 shown in FIGS. 1 to 3 have insulating properties for enduring a high voltage applied between the row direction wiring 1013 and the column direction wiring 1014 on the substrate 1011 and the metal back 1019 on the inner surface of he face plate 1017, and that the spacers 1020 have conductivity at the degree of preventing the charging on the surface of the spacers 1020. Accordingly, the spacers 1020 of the present embodiment include the high resistance films **1020*b* formed on the surface of the insulating matrices 1020*a* with the object of the prevention of the charging, and the low resistance films (conductive films) 1020*c* formed on the surfaces abutting on the inner side of the face plate 1017 (the metal back 1019) and the surface of the substrate 1011 (the row direction wiring 1013 or the column direction wiring 1014) and the side surface portions touched to the abutting surfaces. The necessary number of the spacers 1020 is arranged with necessary intervals between each of them. The high resistance films 1020*b* are formed on at least the portions exposed to the inside of the hermetic container (in the vacuum) of the surfaces of the matrices 1020. Incidentally, in the case where the charging to the spacers 1020 is not so important, the spacers 1020 may be composed of only the insulating matrices 1020*a***.

As the matrices **1020*a* of the spacers 1020, for example, silica glass, the glass increasing small amount of impurities such as Na, soda lime glass, ceramic members such as alumina, and the like are used. Incidentally, the matrices 1020*a* preferably have a coefficient of thermal expansion near to those of the members constituting the hermetic container and the substrate 1011**.

Moreover, the high resistant films **1020*b*** preferably have a sheet resistance (sheet resistivity) within the range of from $10^5$ [Ω/□] to $10^{12}$ [Ω/□] in consideration of the maintenance of the effect of the prevention of charging and the suppression of the power consumption owing to leak currents as described above.

Moreover, the low resistance films **1020*c* may be sufficient to have sufficiently low resistance values in comparison with those of the high resistance films 1020*b*. The materials of the low resistance films 1020*c*** are suitably selected among metals such as Ni, Cr, Au, Mo, W, Pt, Ti, Al, Cu and Pd; alloys; printing conductors composed of the metals or the oxides of metals such as Pd, Ag, Au, $RuO_2$, Pd—Ag and the like, glass and the like; transparent conductors such as $In_2O_3$—$SnO_2$ or the like; semiconductor materials such as poly silicon; and the like.

For connecting the display panel to not shown electric circuits electrically, electrically connecting terminals $D_{x1}$–$D_{xm}$, $D_{y1}$–$D_{yn}$ and Hv of the hermetic container are provided. The electrically connecting terminals $D_{x1}$–$D_{xm}$ are electrically connected to the row direction wiring 1013 of the multi electron beam source. The electrically connecting terminals $D_{y1}$–$D_{yn}$ are electrically connected to the column direction wiring 1014 of the multi electron beam source. The electrically connecting terminal Hv is electrically connected to the metal back 1019 of the face plate 1017.

Moreover, for exhausting the inside of the hermetic container to be vacuum, a not shown exhaust pipe is connected to a vacuum pump to exhaust the inside of the hermetic container to be the degree of vacuum about $1.33\times10^{-5}$ Pa ($10^{-7}$ Torr) after the hermetic container has been assembled. After that, the exhaust pipe is sealed. For keeping the degree of vacuum in the inside of the hermetic container, a getter film (not shown) is formed at a predetermined position in the hermetic container just before the sealing or after the sealing. The getter film is a film formed by heating a getter material containing, for example, Ba as the principal ingredient with a heater or by means of high frequency heating to evaporate it. By the absorption function of the getter film, the inside of the hermetic container is kept to the degree of vacuum in the range of from $1.33\times10^{-3}$ Pa to $10^{-5}$ Pa ($10^{-5}$ to $10^{-7}$ Torr).

By means of the display panel described above, voltages are applied to the surface conduction type electron-emitting devices 1012 through the outside terminals $D_{x1}$–$D_{xm}$ and $D_{y1}$–$D_{yn}$ of the container to make the surface conduction type electron-emitting devices 1012 emit electrons. At the same time, a high voltage in the range of from several hundred volts to several kilovolts is applied to the metal back 1019 through the outside terminal Hv of the container to accelerate the emitted electrons. Then, the emitted electrons impinge on the inner surface of the face plate 1017. Thereby, the phosphor of each color constituting the fluorescent film 1018 is excited to emit light, and an image is displayed.

Generally, the application voltages to the surface conduction type electron-emitting devices 1012 being the cold-cathode devices of the present invention are about 12 to 16 [V]. The distances d between the metal back 1019 and the surface conduction type electron-emitting devices 1012 are about 0.1 to 8 [mm]. The voltages between the metal back 1019 and the surface conduction type electron-emitting devices 1012 are about 0.1 to 10 [kV].

(The Other Embodiments)

The electron-emitting devices of the present invention are not limited to the surface conduction type electron-emitting devices, but any of the other electron-emitting devices of the cold-cathode type electron-emitting devices can be adopted. As a concrete example, there is a field emission type electron-emitting device in which a pair of opposed electrodes are formed along the substrate surface constituting electron sources, which is disclosed in Japanese Patent Application Laid-Open No. S63-274047 by the present applicant.

Moreover, the present invention can be applied to the image display apparatus using electron sources other than the simple matrix type electron sources. For example, in the image display apparatus using a grid to select a surface conduction type electron-emitting device, which is disclosed in Japanese Patent Application Laid-Open No. H2-257551 by the present applicant, it is possible to provide the supporting members (spacers) as described above between the electron sources and the grid, or the like.

The application of the sprit of the present invention is not limited to the image display apparatus, but the sprit of the present invention can be also applied to the light emitting source substituting the light-emitting diode or the like of an optical printer composed of a photosensitive drum, a light-emitting diode and the like. Moreover, at this time, by selecting the m lines of the row direction wiring 1013 and the n lines of the column direction wiring 1014 suitably, the spirit of the present invention can be applied to not only the line-shaped light-emitting source, but also to a two-dimensional light-emitting source. In this case, as the image formation member which is arranged in the region to be radiated by electrons, not only the material such as the phosphors which emit light directly, but also the members which forms latent images generated by the charging of electrons can be used.

Moreover, according to the spirit of the present invention, the present invention can be applied to the case of, for example, an electron microscope in which the member to be radiated by the electrons emitted from the electron sources is one other than the image formation member such as the phosphors or the like. Consequently, the present invention can take the form of a electron beam apparatus which does not specify the member to be radiated.

EXAMPLES

The image display apparatus described in connection with the embodiments described above will be described in detail furthermore. However, the present invention is not limited to the following examples. Incidentally, the image region or the image formation region in the present specification means the space interposed between the region from which electrons are emitted and the region which is radiated by the emitted electrons.

First Example

The display panel shown in FIG. 1 is produced. FIGS. 1, 2 and 5 are referred to while the method of the present example is described.

(Production of Electron Sources)

First, as shown in FIG. 1, the row direction wiring 1013, the column direction wiring 1014, the inter-electrode insulating layers (not shown), the device electrodes and the conductive thin films of the surface conduction type electron-emitting devices 1012 are formed on the substrate 1011.

(Production of Spacers)

Next, the spacers 1020 (see FIG. 1) being the atmospheric pressure resistant structure supporting members of the display panel are produced by the use of the insulating members (300 mm×2 mm×0.2 mm) made of soda lime glass as matrices 1020*a*. The matrices 1020*a* of the spacers 1020 are formed into elongate square poles having cross sections of 2 mm×0.2 mm by the heating drawing method, and the square poles are cut as the need arises.

(Film Formation of High Resistance Films and Conductive Films of Spacers)

High resistance films 1020*b* are formed on four side faces (each front face and rear face of 300 mm×1.98 mm and 300 mm×0.2 mm) of the surfaces of each of the matrices 1020*a* of the spacers 1020 in the image formation region of the hermetic container. Then, each of the conductive films (low resistance films: about 1 [Ω/□]) 1020*c* is formed in the two end surfaces (two surfaces in size of 300 mm×0.2 mm) abutting on the face plate 1017 and the rear plate 1015, and the residual regions excluding the parts in the range of 10 mm from both ends in the longer direction of the spacer 1020 (the X-direction in FIG. 1) from the regions on the two wider side faces (sized in 300 mm×2 mm) in the range of 0.1 mm from the above-mentioned two end faces.

As an example, nitrided Cr—Al films (having the thickness of 200 nm and the sheet resistance of about $10^9$ [Ω/□]) are formed as the high resistance films 1020*c* by sputtering the targets of Cr and Al simultaneously with a high frequency electric supply. The conductive film 1020*c* aims to secure the electrical connection between the high resistance films 1020*c* formed on the spacers 1020 and the face plate 1017, and the electrical connection between the high resistance films 1020*b* and the rear plate 1015. In addition, the conductive films 1020*c* performs the orbit control of the electron beams from the electron-emitting devices 1012 by suppressing the electric fields around the spacers 1020.

(Production of Grid)

Next, the grid 1021 (see FIG. 1) being the secondary electron shield of the display panel is produced by the use of a 426-alloy plate (sized in 300 mm×300 mm×0.05 mm).

First, projection worked portions (having an inner width in the range of from 0.203 mm to 0.206 mm and the depth of 0.2 mm) being the grid groove portions 1022 are formed in the 426-alloy plate with the same intervals as those of the spacers 1020 by press working, etching working or the like. By the formation of the projection worked portions, the recessed portions 1024*a* to be fitted to the spacers 1020 are formed on one principal surface of the grid 1021, and the projected portions 1024*b* abutting on the rear plate 1015 are formed on the other principal surface of the grid 1021. The depths of the projection worked portions are set to 0.2 mm. However, the shallower the depths are, the more the depths are desirable because the influence to the orbits of the electron beams around the projection worked portions is less. After that, circular or elliptic apertures having diameters within the range of from 0.02 mm to 0.50 mm are formed on the plane portions except the projection worked portions by etching working, laser working or press working. The apertures are used as the grid aperture portions 1023 having the intervals of pitches of 0.6 mm same as the intervals of the pitches of 0.6 mm of the surface conduction type electron-emitting devices 1012. Hereupon, the apertures to be the grid aperture portions 1023 are formed in one-to-one correspondence to the surface conduction type electron-emitting devices 1012. However, the apertures may be formed to be continuous slits parallel to the longer direction of the spacers 1020. After the working of the apertures, the surfaces of the grid 1021 are covered with oxide films by annealing processing. Lastly, the peripheral regions wider than the image region of the face plate 1017 are cut off by laser working or the like.

Although the 426-alloy is used as the matrices 1020*a* here, ceramics, glass and the like having coefficients of thermal expansion close to those of the face plate 1017 and the rear plate 1015 can be also used as the matrices 1020*a* by forming them to have projected shapes and apertures similar to the projection worked portions and the apertures of the grid 1021, respectively, and by performing conductivity surface processing to the ceramics, the glass and the like.

(Assembly of Side Wall)

The side wall 1016 made of soda lime glass (having an external form sized to be 350×350×1.9 mm and a width sized to be 10 mm) is joined to the rear plate 1015 with an insulating adhesive 1032 (LS 3081 made by Nippon Electric Glass Co., Ltd.). An example of the baking temperature at this time is 450° C.

(Assembly of Spacers)

First, one end of each of the spacers 1012 (sized to be 300 mm×0.2 mm) is fitted to the grid groove portions 1022 of the grid 1021. Thereby, the low resistance films 1020*c* at the ends of the spacers 1012 are touched to the groove portions 1022, and the grid 1021 and the fitted portions of the spacers 1020 are electrically connected to each other. As the need arises, the fitted portions of the ends of the spacers 1020 and the groove portions 1022 are joined with a conductive adhesive, for example, Pyro-Duct (a trade name) made by Aremco Products Inc., or the like. Thereby, the joining strength of the spacers 1020 and the grid 1021 increase.

Next, an insulating adhesive (for example, Aron Ceramic D (a trade name) made by Toagosei Co., Ltd., or the like) is coated on the external surface of the grid groove portions 1022, which abuts on the rear plate 1015. After the coating, the spacers 1020 and the row direction wiring 1013 are aligned to coincide with each other. Then, the adhesive is heated to be stiffened (at the temperature of 200° C.). Thereby, the spacers 1020 are fixed to the row direction wiring 1013. After the fixation, the grid 1021 is electrically connected to the grid feeding wiring (not shown) on the rear plate 1015 by soldering or by means of an inorganic conductive adhesive for enabling the connection of the grid 1021 to an external power supply. Hereupon, the insulating adhesive is coated on the portions of the grid groove portions 1022 which abut on the rear plate 1015, but the fixation of the grid groove portions 1022 to the rear plate 1015 may be sufficient to be formed in an insulating state. That is, for example, insulating layers may be formed on the row direction wiring 1013.

The adhesive 1031 is coated at portions of the inner surface of the face plate 1017 where the face plate 1017 abuts on the upper surface of the side wall 1016 (see FIG. 3).

(Sealing of Rear Plate and Face Plate)

After that, as shown in FIG. 4, the face plate 1017 and the rear plate 1015 are opposed to each other, and aligned to each other. Then, the face plate 107 and the rear plate 1015 are heated to the temperature of 450° C. to be joined to each other. At this time, the softened adhesive 1030 and the spacers 1020 are touched to each other, and are connected to each other.

(Electron Source Processing and Sealing)

The inside of the hermetic container completed in the way described above is exhausted to have the sufficient degree of vacuum with a vacuum pump through an exhaust pipe. After that, each of the surface conduction electron-emitting devices 1012 are fed through the row direction wiring 1013 and the column direction wiring 1014 by the use of the external terminals $D_{x1}$–$D_{xm}$ and $D_{y1}$–$D_{yn}$ of the container. Then, electric conduction forming processing and electric conduction activation processing are performed. Thereby, the multi electron beam source has been produced.

Next, the not shown exhaust pipe is heated to be welded with a gas burner in the vacuum at the degree of about $1.33\times10^{-4}$ Pa ($1\times10^{-6}$ Torr). Thereby, the envelope (the hermetic container) is sealed.

Lastly, getter processing is performed for keeping the degree of vacuum after the sealing.

(Image Formation)

The display panel which is shown in FIG. 1 and has been completed in the way described above is incorporated in a drive apparatus. Then, scanning signals and modulating signals are severally applied to each of the cold-cathode devices (the surface conduction type electron-emitting devices) 1012 from not shown signal generation means through the external terminals $D_{x1}$–$D_{xm}$ and $D_{y1}$–$D_{yn}$ of the container, and thereby electrons are emitted.

Moreover, a high voltage is applied to the metal back 1019 through the high voltage terminal Hv, and thereby emitted electrons are accelerated. The accelerated emitted electrons impinge on the fluorescent film 1018, and excite each color phosphor to emit light. Thereby, images are displayed.

Incidentally, the voltages are set as follows. That is, the voltage Va applied to the high voltage terminal Hv is within the range of from 3 to 10 [kV]. The voltage Vf applied between each of the wiring 1013 and 1014 is 14 [V]. The voltage applied to the grid 1021 is within the range of from 0.014 to 0.5 [kV].

When the face plate 1017 is irradiated by the electron beams from the rear plate 1015 to make the fluorescent film 1018 emit light in the display panel described above, a part of the electrons in the electron beams is reflected on the metal back 1019, and is charged on the surface of the rear plate 1015 as reflection electrons. Sudden discharges of the charged reflection electrons can be remarkably suppressed by absorbing the reflection electrons with the grid 1021 to prevent the charging of the rear plate 1015.

As the result, clear color image display having good color reproducibility without any discharges can be obtained. Moreover, the recessed portions and the projected portions are formed by forming the letter U-like portions in cross section in the grid. The grid abuts on the substrate (the rear plate or the face plate) at the projected portions, and the spacers are fitted to the recessed portions of the grid. Thereby, the distance between the substrate and the grid can be regulated, and the distance between the spacers and the apertures through which electrons pass can be regulated. Consequently, the influences to electron beam orbits owing to the misalignment of the grid and the spacer to the substrate can be decreased. Thereby, good images can be obtained.

Second Example

Figure 7:
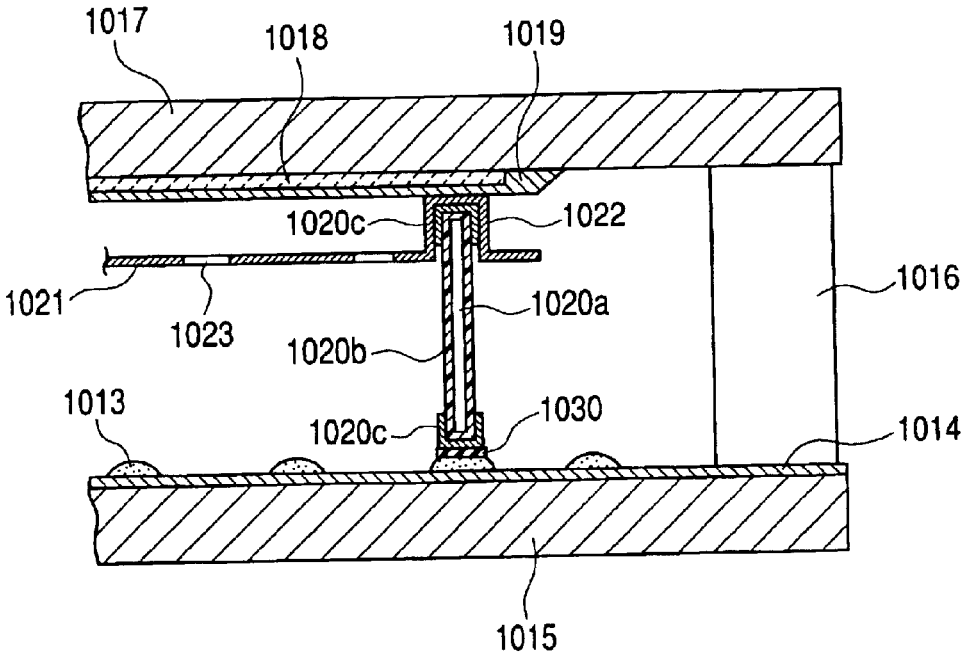
FIG. 7 is a sectional view of a display panel according to an image display apparatus of a second embodiment of the present invention.

FIGS. 1 and 7 are referred to while a second example of the present invention is described. The present example takes the configuration in which the grid 1021 is fitted to the end surfaces of the spacers 1020 on the side of the face plate 1017. The descriptions in connection with the same configurations and the processes as those of the first example are omitted.

(Production of Grid)

Next, the grid 1021 (see FIG. 7) being the reflected electron shield of the display panel is produced by the use of a 48-Ni alloy plate (sized in 300 mm×300 mm×0.05 mm).

First, projection worked portions (having an inner width in the range of from 0.203 mm to 0.206 mm and a depth in the range of from 0.2 mm to 1 mm) being the grid groove portions 1022 are formed in the 48-Ni alloy plate with the same intervals as those of the spacers 1020 by press working, etching working or the like. The depths of the projection worked portions are set to be within the range of from 0.2 mm to 1 mm. However, the deeper the depths are, the wider the interval of the grid 1021 and the face plate 1017 becomes. Consequently, even when the grid 1021 and the periphery thereof are charged by the electrons reflected from the face plate 1017, it is difficult to cause the discharge of the charged electrons, which is more desirable. After that, circular or elliptic apertures having diameters within the range of from 0.25 mm to 0.55 mm are formed on the plane portions except the projection worked portions by etching working, laser working or press working. The apertures are used as the grid aperture portions 1023 having the intervals of pitches of 0.6 mm same as the intervals of the pitches of 0.6 mm of the surface conduction type electron-emitting devices 1012. Hereupon, the apertures to be the grid aperture portions 1023 are formed in one-to-one correspondence to the surface conduction type electron-emitting devices 1012. However, the apertures may be formed to be continuous slits parallel to the longer direction of the spacers 1020. After the working of the apertures, the peripheral regions wider than the image region of the face plate 1017 are cut off by laser working or the like as the need arises. Lastly, the surfaces of the grid 1021 are covered with black oxide films by annealing processing.

Although the 48-Ni alloy is used as the matrices 1020*a* here, ceramics, glass and the like having coefficients of thermal expansion close to those of the face plate 1017 and the rear plate 1015 can be also used as the matrices 1020*a* by forming them to have projected shapes and apertures similar to the projection worked portions and the apertures of the grid 1021, respectively, and by performing conductivity surface processing to the ceramics, the glass and the like.

(Assembly of Spacers)

First, one end of each of the spacers 1012 (sized to be 300 mm×0.2 mm) is fitted to the grid groove portions 1022 of the grid 1021. As the need arises, the fitted portions of the ends of the spacers 1020 and the groove portions 1022 may be joined with a conductive adhesive (for example, Pyro-Duct (a trade name) made by Aremco Products Inc., or the like), or welding by soldering (Cerasolzer (a trade name) made by Asahi Glass Co., Ltd., or the like).

Next, a conductive adhesive (for example, Pyro-Duct (a trade name) made by Aremco Products Inc., a conductive frit or the like) is coated on the external surface of the grid groove portions 1022, which abuts on the face plate 1017. After the coating, the face plate 1017 is heated to be stiffened (at the temperature of abut 200° C. to Pyro-Duct, and at the temperature of about 380° C. to the conductive frit). At this time, a part of the grid 1021 is electrically connected to the high voltage terminal Hv.

The adhesive 1030 is coated at portions of the inner surface of the face plate 1017 where the face plate 1017 abuts on the upper surface of the side wall 1016 (see FIG. 7).

(Sealing of Rear Plate and Face Plate)

After that, as shown in FIG. 7, the face plate 1017 and the rear plate 1015 are opposed to each other, and aligned so as to coincide with the spacers 1020 and the row direction wiring 1013. Then, the face plate 107 and the rear plate 1015 are heated to the temperature of 450° C. to be joined to each other. At this time, the softened adhesive 1030 and the spacers 1020 are touched to each other, and are connected to each other.

(Image Formation)

The display panel which is shown in FIG. 1 and has been completed in the way described above is incorporated in a drive apparatus. Then, scanning signals and modulating signals are severally applied to each of the cold-cathode devices (the surface conduction type electron-emitting devices) 1012 from not shown signal generation means through the external terminals $D_{x1}$–$D_{xm}$ and $D_{y1}$–$D_{yn}$ of the container, and thereby electrons are emitted.

Moreover, a high voltage is applied to the grid 1021 through the high voltage terminal Hv, and thereby emitted electrons are accelerated. The accelerated emitted electrons impinge on the fluorescent film 1018, and excite each color phosphor to emit light. Thereby, images are displayed.

Incidentally, the voltages are set as follows. That is, the voltage Va applied to the high voltage terminal Hv is within the range of from 3 to 10 [kV], and the voltage Vf applied between each of the wiring 1013 and 1014 is 15 [V].

When the face plate 1017 is irradiated by the electron beams from the rear plate 1015 to make the fluorescent film 1018 emit light in the display panel described above, a part of the electrons in the electron beams is reflected on the metal back 1019, and reaches the surface of the rear plate 1015 as reflection electrons to charge the rear plate 1015. Sudden discharges caused by the charged rear plate 1015 can be remarkably suppressed by absorbing the reflection electrons with the grid 1021 to prevent the charging of the rear plate 1015. As the result, clear color image display having good color reproducibility without any discharges can be obtained.

Although the face plate 1017 and the grid 1021 are electrically joined by means of the conductive adhesive to make them have the same electric potential, but an insulating adhesive can be used. In that case, the electric potential of the face plate 1017 and the electric potential of the grid 1021 differ from each other. Thereby, it is possible to limit the spread extent of the orbits of the electrons impinging on the fluorescent film 1018 to a predetermined extent. Moreover, the recessed portions and the projected portions are formed by forming almost the letter U-like portions in cross section in the grid. The grid 1021 abuts on the substrate (the rear plate or the face plate) at the projected portions, and the spacers are fitted to the recessed portions of the grid. Thereby, the distance between the substrate and the grid can be regulated, and the distance between the spacers and the apertures through which electrons pass can be regulated. Consequently, the influences to electron beam orbits owing to the misalignment of the grid and the spacer to the substrate can be decreased. Thereby, good images can be obtained.

Third Example

Figure 8:
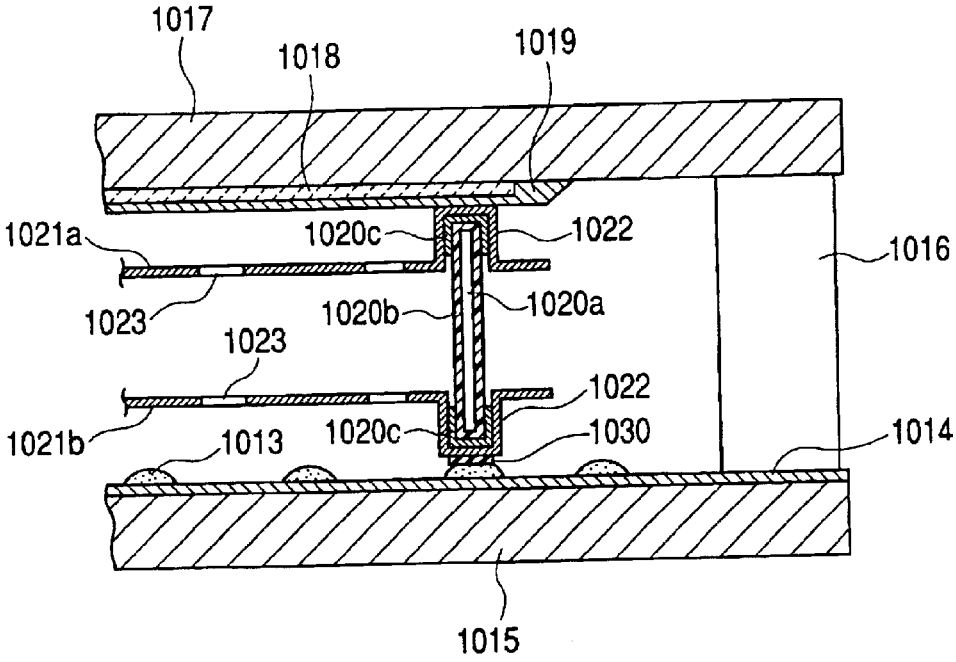
FIG. 8 is a sectional view of a display panel according to an image display apparatus of a third embodiment of the present invention.

FIGS. 1 and 8 are referred to while a third example of the present invention is described. The present example takes the configuration in which the grid 1021 is fitted to the end surfaces of the spacers 1020 on the side of the face plate 1017 and the end surfaces of the spacers 1020 on the side of the rear plate 1015. The descriptions in connection with the same configurations and the processes as those of the first example are omitted.

(Production of Grid)

The grid 1021 (see FIG. 8) being the second electron shield of the display panel is produced by the use of a 48-Ni alloy plate (sized in 300 mm×300 mm×0.05 mm).

As the grid 1021, two sheets of grids of a grid 1021*a* on the side of the face plate 1017 and a grid 1021*b* on the side of the rear plate 1015 are produced.

First, projection worked portions (having an inner width in the range of from 0.203 mm to 0.206 mm and a depth in the range of from 0.2 mm to 1 mm to the grid 1021*a*, and having an inner width in the range of from 0.203 mm to 0.206 mm and a depth in the range of from 0.1 mm to 0.2 mm to the grid 1021*b*) being the grid groove portions 1022 are formed in both of the two 48-Ni alloy plates with the same intervals as those of the spacers 1020 by press working, etching working or the like. After that, apertures are formed on the plane portions of the two grids 1021 except the projection worked portions by etching working, laser working or press working. The apertures are used as the grid aperture portions 1023 having the intervals of pitches same as the intervals of the pitches of the surface conduction type electron-emitting devices 1012. At this time, the diameters of the apertures to be formed in each of the grids 1021 are within the range of from 0.25 mm to 0.55 mm in the grid 1021*a*, and within the range of from 0.02 mm to 0.50 mm in the grid 1021*b*.

After the working of the apertures, the peripheral regions wider than the image region of the face plate 1017 are cut off as the need arises.

(Assembly of Spacers)

First, both ends of each of the spacers 1012 (sized to be 300 mm×0.2 mm) are fitted to the grid groove portions 1022 of the grids 1021*a* and 1021*b*. The grid 1021*a* is fitted to the end surfaces of the spacers 1020 on the side of the face plate 1017, and the grid 1021*b* is fitted to the end surfaces of the spacers 1020 on the side of the rear plate 1015. The spacers 1020 are fitted to the grids 1021*a* and 1021*b* in order that the center lines of the apertures of the grids 1021*a* and 1021*b* may coincide with each other.

As the need arises, the fitted portions of the ends of the spacers 1020 and the groove portions 1022 may be joined with a conductive adhesive (for example, Pyro-Duct (a trade name) made by Aremco Products Inc., or the like).

Next, a conductive adhesive (for example, Aron Ceramic D (a trade name) made by Toagosei Co., Ltd., or the like) is coated on the external surface of the grid groove portions 1022 of the grid 1021*b* on the side of the rear plate 1015. After the coating, the grid 1021*b* is aligned so as to coincide with the spacers 1020 and the row direction wiring 1013, and then the grid 1021*b* is heated to be stiffened (at the temperature of abut 200° C.). Then, the grid 1021*b* is fixed to the rear plate 1015.

The adhesive 1031 is coated at portions of the inner surface of the face plate 1017 where the face plate 1017 abuts on the upper surface of the side wall 1016 (see FIG. 1).

(Sealing of Rear Plate and Face Plate)

After that, as shown in FIG. 8, the face plate 1017 and the rear plate 1015 are opposed to each other, and aligned so as to coincide with the spacers 1020 and the row direction wiring 1013. Then, the face plate 107 and the rear plate 1015 are heated to the temperature of 450° C. to be joined to each other. At this time, the softened adhesive and the grid 1021*a* on the side of the face plate 1017 are touched to each other, and are connected to each other.

After this, each process of the sealing of the rear plate 1015 and the face plate 1017, electron source processes and sealing is the same as that of the first example.

(Image Formation)

The display panel which is shown in FIG. 1 and has been completed in the way described above is incorporated in a drive apparatus. Then, scanning signals and modulating signals are severally applied to each of the cold-cathode devices (the surface conduction type electron-emitting devices) 1012 from not shown signal generation means through the external terminals $D_{x1}$–$D_{xm}$ and $D_{y1}$–$D_{yn}$ of the container, and thereby electrons are emitted.

Moreover, a high voltage is applied to the grid 1021*a* through the high voltage terminal Hv, and a low voltage is applied to the grid 1021*b*. Thereby, emitted electrons are accelerated to impinge on the fluorescent film 1018, and excite each color phosphor to emit light. Thereby, images are displayed.

Incidentally, the voltages are set as follows. That is, the voltage Va applied to the grid 1021*a* is within the range of from 8 to 15 [kV]. The voltage applied to the grid 1021*b* is within the range of from 0.015 to 0.5 [kV]. The voltage Vf applied between each of the wiring 1013 and 1014 is 15 [V].

When the face plate 1017 is irradiated by the electron beams from the rear plate 1015 to make the fluorescent film 1018 emit light in the display panel described above, a part of the electrons in the electron beams is reflected on the metal back 1019, and reach the surface of the rear plate 1015 as reflection electrons to charge the rear plate 1015. Sudden discharges caused by the charged rear plate 1015 can be remarkably suppressed by absorbing the reflection electrons with the grid 1021 to prevent the charging of the rear plate 1015. As the result, clear color image display having good color reproducibility without any discharges can be obtained.

Although the face plate 1017 and the grid 1021*a* are electrically joined by means of the conductive adhesive to make them have the same electric potential in the present example, but an insulating adhesive can be used. In that case, the electric potential of the face plate 1017 and the electric potential of the grids 1021*a* and 1021*b* are severally controlled to differ from each other so as to meet the following relation: (the electric potential of the face plate 1017)≧(the electric potential of the grid 1021*a*)≧(the electric potential of the grid 1021*b*). Thereby, it is possible to limit the spread extent of the orbits of the electrons impinging on the fluorescent film 1018 closer to a predetermined extent in comparison with the second example. Moreover, the recessed portions and the projected portions are formed by forming almost the letter U-like portions in cross section in the grid 1021. The grid 1021 abuts on the substrate (the rear plate or the face plate) at the projected portions, and the spacers are fitted to the recessed portions of the grid. Thereby, the distance between the substrate and the grid can be regulated, and the distance between the spacers and the apertures through which electrons pass can be regulated. Consequently, the influences to electron beam orbits owing to the misalignment of the grid and the spacer to the substrate can be decreased. Thereby, good images can be obtained.

Fourth Example

FIGS. 1 and 10 are referred to while a fourth example of the present invention is described. The present example takes the configuration in which the structure of the grid 1021 of the first example is changed. The descriptions in connection with the same configurations and the processes as those of the first example are omitted.

(Production of Grid)

Next, the grid 1021 (see FIG. 10) being the second electron shield of the display panel is produced by the use of a 50-Ni alloy plate (sized in 300 mm×300 mm×0.2 mm).

First, groove worked portions (having an inner width in the range of from 0.203 mm to 0.206 mm and the depth of 0.1 mm) being the grid groove portions 1022 are formed only at the portions to abut on the spacers 1020 in the 50-Ni alloy plates with the same intervals as those of the spacers 1020 by etching working, laser working or the like. Although the depths of the groove worked portions are set 0.1 mm, the depths are more desirable when the depths are deeper, because the fitting to the spacers 1020 becomes stronger. After that, insulating layers 1201 are formed at the portions of the grid 1021 at which the grid 1021 abuts on the row direction wiring 1013 of the rear plate 1015. The insulating layers 1201 are made of an insulating material such as Aron Ceramic D made by Toagosei Co., Ltd., or the like. The insulating layers 1201 may be formed on the row direction wiring 1013 other than the row direction wiring 1013 on which the spacers 1020 are located. After that, circular or elliptic apertures having diameters within the range of from 0.02 mm to 0.50 mm are formed on the plane portions except the groove worked portions by etching working, laser working or press working. The apertures are used as the grid aperture portions 1023 having the intervals of pitches of 0.6 mm same as the intervals of the pitches of 0.6 mm of the surface conduction type electron-emitting devices 1012. Hereupon, the apertures to be the grid aperture portions 1023 are formed in one-to-one correspondence to the surface conduction type electron-emitting devices 1012. However, the apertures may be formed to be continuous slits parallel to the longer direction of the spacers 1020. Moreover, after the working of the apertures, the surfaces of the grid 1021 are covered with oxide films by annealing processing. Lastly, the peripheral regions wider than the image region of the face plate 1017 are cut off by laser processing or the like as the need arises.

Although the 50-Ni alloy is used as the grid 1021 here, ceramics, glass and the like having coefficients of thermal expansion close to those of the face plate 1017 and the rear plate 1015 can be also used as the grid 1021 by forming them to have projected shapes and apertures similar to the projection worked portions and the apertures of the grid 1021, respectively, and by performing conductivity surface processing to the ceramics, the glass and the like.

(Image Formation)

The display panel which is shown in FIG. 1 and has been completed in the way described above is incorporated in a drive apparatus. Then, scanning signals and modulating signals are severally applied to each of the cold-cathode devices (the surface conduction type electron-emitting devices) 1012 from not shown signal generation means through the external terminals $D_{x1}$–$D_{xm}$ and $D_{y1}$–$D_{yn}$ of the container, and thereby electrons are emitted.

Moreover, a high voltage is applied to the metal back 1019 through the high voltage terminal Hv, and thereby emitted electrons are accelerated to impinge on the fluorescent film 1018. Consequently, each color phosphor is excited to emit light. Thereby, images are displayed.

Incidentally, the voltages are set as follows. That is, the voltage Va applied to the high voltage terminal Hv is within the range of from 3 to 10 [kV]. The voltage Vf applied between each of the wiring 1013 and 1014 is 14 [V]. The voltage applied to the grid 1021 is within the range of from 0.014 to 0.5 [kV].

When the face plate 1017 is irradiated by the electron beams from the rear plate 1015 to make the fluorescent film 1018 emit light in the display panel described above, a part of the electrons in the electron beams is reflected on the metal back 1019, and reach the surface of the rear plate 1015 as reflection electrons to charge the rear plate 1015. Sudden discharges caused by the charged rear plate 1015 can be remarkably suppressed by absorbing the reflection electrons with the grid 1021 to prevent the charging of the rear plate 1015.

As the result, clear color image display having good color reproducibility without any discharges can be obtained. Moreover, the recessed portions are formed in the grid 1021, and the spacers 1020 are fitted to the recessed portions. Furthermore, the grid 1021 abuts on the substrate (the rear plate or the face plate) at the bottom portions of the recessed portions. Thereby, the distance between the substrate and the grid 1021 can be regulated, and the distance between the spacers and the apertures through which electrons pass can be regulated. Consequently, the influences to electron beam orbits owing to the misalignment of the grid and the spacers to the substrate can be decreased. Thereby, good images can be obtained.

As described above, according to the present invention, the influences to electron beam orbits owing to the misalignment of the potential regulation plate and the spacers to the substrate can be decreased. Thereby, good images can be obtained. Moreover, unexpected discharges in the apparatus can be decreased, and the damages of the face plate and the rear plate owing to discharges can be decreased.

What is claimed is:

1. An electron beam apparatus including a first substrate having a region from which electrons are emitted, a second substrate having a region which is irradiated with the emitted electrons, and at least one spacer disposed between said first substrate and said second substrate to form an atmospheric pressure resistant structure, said apparatus characterized by:

at least one potential regulation plate provided between said first substrate and said second substrate, said potential regulation plate including an aperture portion through which electrons emitted from said first substrate pass, wherein said potential regulation plate includes a recessed portion, to which said spacer fitted, on one principal surface of said potential regulation plate, and a part of the other principal surface of said potential regulation plate abuts on said first substrate or said second substrate in a state in which said spacer is fitted to said recessed portion.

2. The electron beam apparatus according to claim 1, wherein there are provided at least two of said potential regulation plates, one of said potential regulation plates abutting on said first substrate, another of said potential regulation plates abutting on said second substrate.

3. The electron beam apparatus according to claim 1, wherein a projected portion is formed at an abutting portion where the other principal surface of said potential regulation plate abuts at said first substrate or said second substrate.

4. The electron beam apparatus according to claim 3, wherein said projected portion of said potential regulation plate is formed directly under said recessed portion.

5. The electron beam apparatus according to claim 4 wherein said projected portion and said recessed portion are integrally formed on said potential regulation plate to form a cross section portion having the shape of a letter U or a letter U with a flat bottom.

6. The electron beam apparatus according to claim 3, wherein said projected portion of said potential regulation plate abuts on an abutting portion of said first substrate with an insulating material being interposed between said projected portion and said abutting portion.

7. The electron beam apparatus according to claim 1, wherein an envelope is constructed by said first substrate, said second substrate, said spacer and a frame for fixing said first substrate and said second substrate, and said potential regulation plate is electrically connected to a potential supply source outside of said envelope.

8. The electron beam apparatus according to claim 1, wherein said potential regulation plate is a metal plate.

9. The electron beam apparatus according to claim 1, wherein said spacer comprises an insulating substrate.

10. The electron beam apparatus according to claim 1, wherein said spacer comprises an insulating substrate on whose surface a high resistance film is formed.

11. The electron beam apparatus according to claim 10, wherein said high resistance film has a sheet resistance within a range of from $10^5$ to $10^{12}$ Ω/□.

12. The electron beam apparatus according to claim 1, a cold-cathode device is provided in said region from which electrons are emitted.

13. The electron beam apparatus according to claim 12, wherein said cold-cathode device is a surface conduction type electron-emitting device.

14. The electron beam apparatus according to claim 10, wherein a low resistance film having a lower resistance than that of said high resistance film is formed at a portion of said spacer where said spacer abuts on said potential regulation plate.

15. The electron beam apparatus according to claim 10, wherein the other principal surface of said potential regulation plate abuts on said first substrate or said second substrate, and said spacer abuts on said second substrate or said first substrate on which the other principal surface does not abut, and further a low resistance film having a resistance lower than that of said high resistance film is formed on a portion of said spacer on which said second substrate or said first substrate abuts.

16. The electron beam apparatus according to claim 14, wherein said low resistance film is made of a metal.

17. The electron beam apparatus according to claim 12, wherein said spacer is arranged on wiring for driving said cold cathode device.

18. The image display apparatus, comprising an electron beam apparatus according to claim 1, wherein an image formation member forming an image by impingement of electrons is provided in said region of said electron beam apparatus, said region irradiated with emitted electrons.

* * * * *

UNITED STATES PATENT AND TRADEMARK OFFICE

CERTIFICATE OF CORRECTION

PATENT NO. : 6,828,722 B2
DATED : December 7, 2004
INVENTOR(S) : Kazuyuki Ueda et al.

It is certified that error appears in the above-identified patent and that said Letters Patent is hereby corrected as shown below:

Title page,
Item [56], References Cited, U.S. PATENT DOCUMENTS, "M.I. Elinson, et al., The Emission of Hot Electrons and the Field Emission of Electrons form Tix Oxide, Radio Eng. Electron Phys., 1965, pp. 1290-1296." should read -- M.I. Elinson, et al., The Emission of Hot Electrons and the Field Emission of Electrons from Tin Oxide, Radio Eng. Electron Phys., 1965, pp. 1290-1296. --.

Column 1,
Lines 9 and 10, "an" should read -- a --.

Column 3,
Line 30, "an" should read -- a --.
Line 65, "fist" should read -- lust --.
Line 66, "is" should read -- are --.

Column 4,
Line 40, "show," should read -- shown --.

Column 5,
Line 15, "an" should read -- a --.

Column 7,
Line 37, "he" should read -- the --.

Column 10,
Line 11, "for" should be deleted.

Column 11,
Lines 61 and 62, "sprit" should read -- spirit --.

UNITED STATES PATENT AND TRADEMARK OFFICE

CERTIFICATE OF CORRECTION

PATENT NO. : 6,828,722 B2
DATED : December 7, 2004
INVENTOR(S) : Kazuyuki Ueda et al.

It is certified that error appears in the above-identified patent and that said Letters Patent is hereby corrected as shown below:

Column 21,
Line 33, "claim 4" should read -- claim 4, --.

Signed and Sealed this

Twenty-sixth Day of April, 2005

JON W. DUDAS
*Director of the United States Patent and Trademark Office*